United States Patent [19]

Feldkämper

[11] 4,266,469

[45] May 12, 1981

[54] METHOD FOR MAKING SACKS PROVIDED WITH CROSS-BOTTOMS

[75] Inventor: Richard Feldkämper, Lengerich of Westphalia, Fed. Rep. of Germany

[73] Assignee: Windmoller & Holscher, Lengerich, Fed. Rep. of Germany

[21] Appl. No.: 20,465

[22] Filed: Mar. 14, 1979

[30] Foreign Application Priority Data

Mar. 17, 1978 [DE] Fed. Rep. of Germany ..... 2811857

[51] Int. Cl.[3] ..... B31B 1/62; B31B 1/84

[52] U.S. Cl. ..... 493/219; 493/224

[58] Field of Search ..... 93/35 SB, 8 VB

[56] References Cited

U.S. PATENT DOCUMENTS 3,195,424 7/1965 Camerini ..... 93/35 SB X 3,272,093 9/1966 Brockmuller ..... 93/8 VB 3,473,446 10/1969 Berghgracht ..... 93/35 SB

FOREIGN PATENT DOCUMENTS 1511003 7/1969 Fed. Rep. of Germany ..... 93/8 VB

*Primary Examiner*—Robert D. Baldwin

*Attorney, Agent, or Firm*—Fleit & Jacobson

[57] ABSTRACT

A web of bag-making material has folded rectangular sheets adhered at intervals to one face by one flap of each sheet before longitudinal margins of the web are folded over, stuck to the other flap of each sheet and joined where they overlap to define a tube, whereafter sections are severed from the tube to make bags to be formed with cross-bottom closures at the ends. The size and position of the folded sheets are such that each sheet will subsequently form an internal seal for the cross-bottom closure.

8 Claims, 4 Drawing Figures

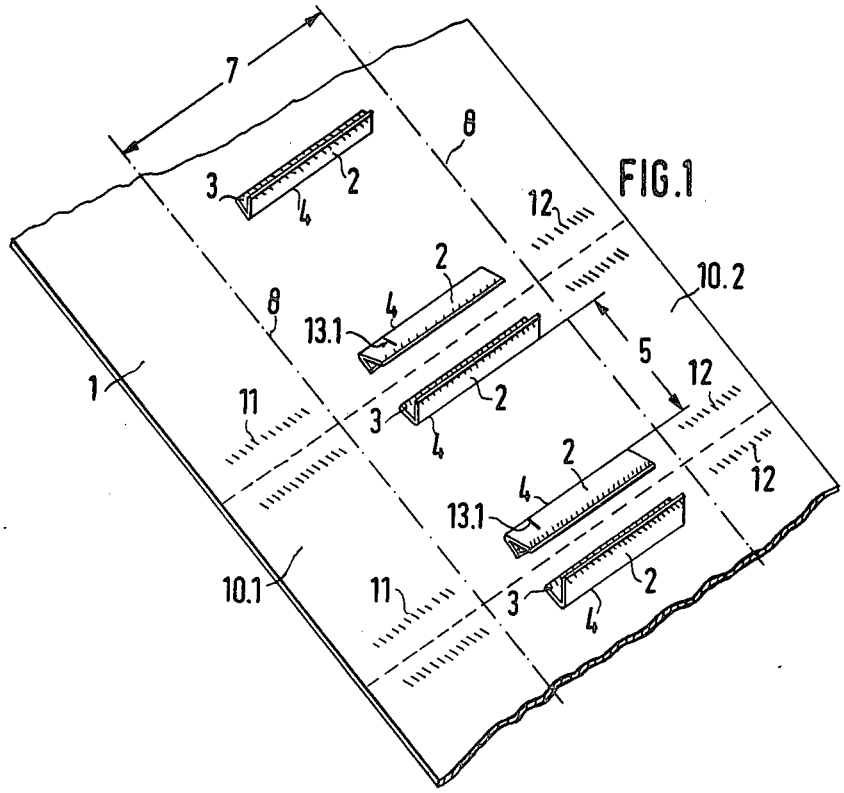
FIG.1
FIG.3
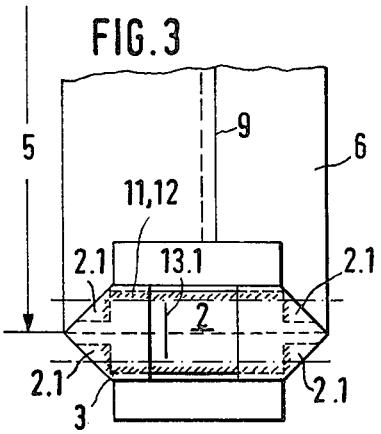
FIG.2
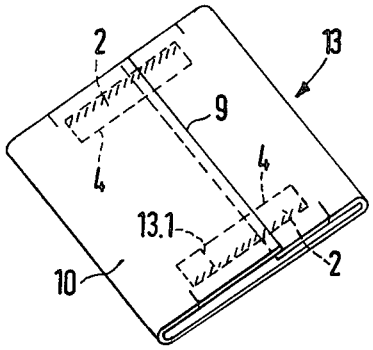

METHOD FOR MAKING SACKS PROVIDED WITH CROSS-BOTTOMS

The invention relates to a method of making sacks provided with cross-bottoms, wherein a web of material is converted to a flattened tubular web by folding over the side portions, of which the overlapping margins are interconnected by a longitudinal seam, tube sections are severed from said tubular web, and the ends of the tube sections are formed with bases by being pulled open and folded inwardly and by the resulting overlapping side flaps being cemented together with the incorporation of the adjoining angles of the corner folds.

In known sacks of this kind which mostly consist of paper, the bases are not leakproof because the side flaps do not fully and sealingly adhere to the underlying parts of the corner folds. This causes channels to be formed, particularly in the region of the fold-lines, through which pourable material can escape from the sack.

To improve the seal of the bases, it is known to insert labels as internal locks in the pulled-open bases or to stick base labels onto the closed bases. The feeding and application of labels to the pulled-open or closed bases is not only expensive but also fails to bring satisfactory results in all cases.

It is therefore the problem of the present invention to provide a method of the aforementioned kind in which internal locks which efficiently seal the bases can be simply supplied and applied.

According to the invention, this problem is solved in that folded labels which define internal locks, are longer than the spacing between the bases of the subsequent corner folds and wider than the subsequent base width are applied to the as yet open web with the fold-lines facing the subsequent middle of the bag, the lower portions of the folded labels are cemented thereon along their outer margins at a position adjoining or closely behind the subsequent lines of cut for severing the tube sections, and the upper marginal portion of the folded labels or the side portions of the web coming into contact therewith after folding over are provided with applications of adhesive so that they adhere to the side portions of the web after these have been folded over to form one wall of the sack. According to the method of the invention, the labels forming the internal locks cannot only be easily supplied and applied in that they are stuck to the as yet flat initial web which is easily accessible but the internal locks are also adapted to provide a particularly good seal for the bases because they engage under the susequent corner folds and are folded therewith, which would encounter difficulties and be expensive after formation of the tube and after the bases have been pulled open. In the finished base, the internal locks extend beneath the corner folds so that any material escaping from the base must first overcome the edges of the internal locks as well as of the corner folds, whereby a labyrinth seal is created. The further the internal locks engage under the corner folds for being folded together therewith, the more secure will the labyrinth seal be.

One example of the invention will now be described in more detail with reference to the drawing, wherein:

FIG. 1 is a perspective view of a section of an as yet flat web of material having adhered thereto folded labels which form internal locks;

FIG. 2 shows a tube section severed from the tubular web formed from the web of FIG. 1;

FIG. 3 shows an end of the tube section with the base pulled open and,

Figure 4:
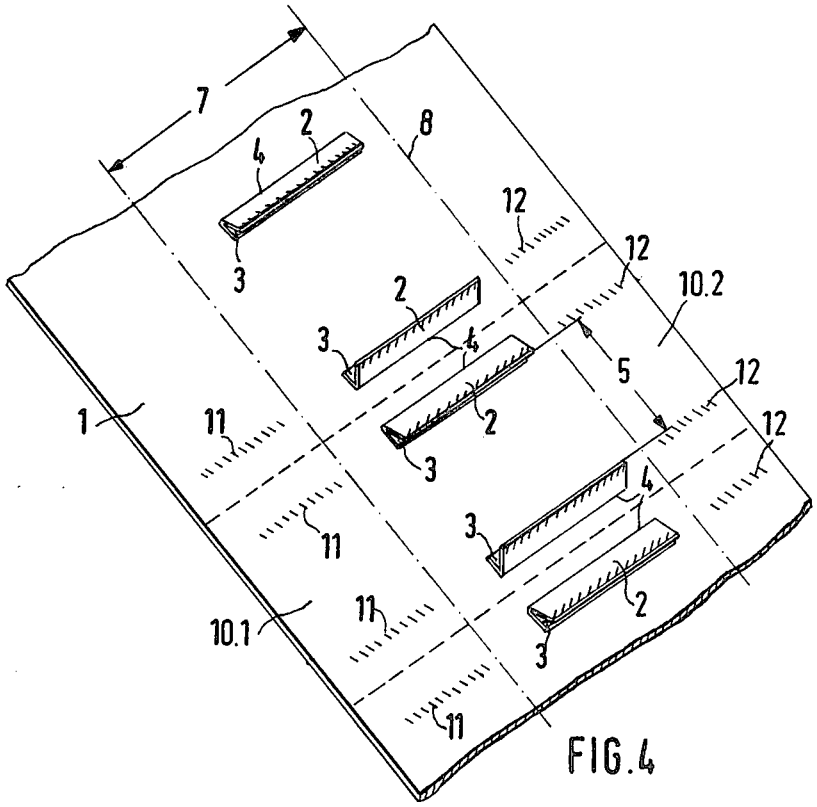
FIG. 4 is a view similar to FIG. 1 with the folded labels adhered thereto in reverse arrangement.

Internal locks 2 are applied at intervals to a web 1 of kraft paper or consisting of a plurality of layers. The internal locks are folded centrally upon themselves parallel to their longitudinal side and they are applied by means of an adhesive strip 3 running closely adjacent their first longitudinal edge, their fold-lines 4 being directed towards each other in pairs and the internal spacing of the internal locks 2 corresponding to the mutual spacing 5 of the subsequent bases of the sack 6.

The internal locks 2 are centrally disposed on the web 1 in the region 7 which later forms one wall of the sacks. Adhesive strips 11, 12 are applied to the web 1 in the region of a wall 10 consisting of the web portions 10.1 and 10.2 which are to be folded about fold-lines 8 during tube formation and closed by a longitudinal seam 9. By means of the adhesive strips 11, 12, the second longitudinal edges of the internal locks 2 are connected to the wall 10 during formation of the tube.

FIG. 2 illustrates a tube section 13 which has been severed along the broken line shown in FIG. 1 from a tubular web formed from the web illustrated in FIG. 1. For the purpose of forming side flaps exhibiting rectangular portions, the tube section 13 is on each side provided with two axially extending incisions.

FIG. 3 shows the end region of a tube section according to FIG. 2 with a base that has been pulled open. However, the base of the sack 6 according to FIG. 3 possesses a longer internal lock 2 in comparison with FIGS. 1 and 2. It will be clear that the corners 2.1 of the internal lock 2 are folded in with the corner folds. The longer the internal locks 2, i.e. the more nearly they approach the fold-lines 8, the shorter will be the gap which remains in the apices of the corner folds and which is not covered by the internal locks 2. A very efficient seal for the bases is achieved in sacks with such internal locks 2.

When adhering the folded internal locks 2 to the as yet open web 1, care should be taken that the adhesive applications 3 and 11, 12 are disposed on the side flaps beyond the base fold-lines shown in chain-dotted lines in FIG. 3.

The fold-line 4 of the internal locks 2 is on the line which subsequently connects the outer angles of the corner folds and which is shown in broken lines in FIG. 3, so that the internal lock lies flat in the pulled-open base up to its portions folded together with the corner folds.

To facilitate connection and introduction of conventional valves, one of the internal locks 2 belonging to each sack workpiece is provided with an incision 13.1 which substantially corresponds to the subsequent base width and is at right-angles to its fold-line 4.

As will be evident from FIG. 4, the folded labels forming the internal locks 2 can be stuck to the as yet open web with the fold-lines 4 pointing to the subsequent ends of the sack. The internal locks 2 stuck on according to the pattern shown in FIG. 1 are, however, better adapted to the subsequent formation of the cross-bottoms.

I claim:

1. A method of making sacks provided with cross-bottoms comprising:

folding over side portions of a web of material so that margins of the side portions overlap and the web forms a flattened tubular web;

interconnecting the overlapping margins with a longitudinal seam;

severing individual tube sections from the tubular web;

forming a base for an individiual tube section by inwardly folding opposed portions of the bottom of the tube section to define triangular-shaped corner folds having parallel bases spaced from each other with corresponding ends of the parallel bases defining side flaps, folding inwardly the side flaps so that a portion of one side flap overlaps a portion of the other, and interconnecting the overlapping portions of the side flaps to each other; and applying a label folded along a fold line to a central portion of the web of material prior to the folding of the side portions thereof, the label after formation of the base of an individual tube section defining an internal lock, securing the label to the central portion of the web of material prior to folding over of the side portions and securing the label to the side portions after folding thereof, the label having a length sufficient to cover the space between the parallel bases of the corner folds and being applied to the web of material in a position to at least partially close the space after formation of the base of the individual tube section.

2. A method according to claim 1, characterised in that the folded label defining the internal lock is provided at right-angles to its fold-line with an incision substantially corresponding to the subsequent base width for introducing a valve.

3. A method according to claim 1 or claim 2, characterised in that the folded label defining the internal lock is secured to the as yet open web with the fold-line (4) facing the subsequent end of the sack.

4. A method according to claim 1, wherein the overlapping portions of the side flaps are interconnected by being cemented to each other, and wherein the label is cemented to the central portion of the web of material.

5. A method according to claim 1, wherein the label is secured to the side flaps by application of adhesive applied to one of the side portions of the web of material and an upper marginal portion of the label.

6. A method according to claim 1, wherein the label is applied to the central portion of the web of material with its fold line facing the subsequent middle of the sack.

7. A method according to claim 1, wherein the length of the label is such that end portions thereof are folded during formation of the corner folds.

8. A method according to claim 1, wherein the label is applied in such manner that the portion thereof secured to the central portion of the web of material is positioned on one side of a center line of the base and the portion thereof secured to the side portions is positioned on the other side of the center line.

* * * * *